United States Patent [19]

Rohde

[11] 4,337,070

[45] Jun. 29, 1982

[54] CONTINUOUS SYSTEM OF RECTIFICATION

[75] Inventor: Wilhelm Rohde, Munich, Fed. Rep. of Germany

[73] Assignee: Linde Aktiengesellschaft, Wiesbaden, Fed. Rep. of Germany

[21] Appl. No.: 154,676

[22] Filed: May 30, 1980

[30] Foreign Application Priority Data

May 30, 1979 [DE] Fed. Rep. of Germany ..... 2922028

[51] Int. Cl.[3] ..... F25J 3/04

[52] U.S. Cl. ..... 62/18

[58] Field of Search ..... 62/14, 15, 18, 29, 30

[56] References Cited

U.S. PATENT DOCUMENTS

| | | | |
|---|---|---|---|
| 2,650,482 | 9/1953 | Lobo | 62/18 |
| 2,975,606 | 3/1961 | Karwat | 62/14 |
| 3,174,293 | 3/1965 | Jakob et al. | 62/14 |
| 3,736,762 | 6/1973 | Toyama et al. | 62/14 |

*Primary Examiner*—Norman Yudkoff

*Attorney, Agent, or Firm*—Millen & White

[57] ABSTRACT

In the fractionation of a gaseous mixture, e.g., air, by rectification, wherein liquid in the sump of a rectifying column is heated and thereby partially vaporized; and simultaneously sump liquid is withdrawn from a lower zone of the sump liquid bath, and is recycled into the bath above the point of withdrawal, the improvement, prior to the recycle step, of passing the withdrawn sump liquid from the lower zone into a heat exchanger disposed in the sump, said heat exchanger having a substantially sealed bottom end at a level below the liquid level of the sump, and an open top end at a level higher than the liquid level of the sump; said withdrawn sump liquid being passed into the bottom end of said heat exchanger and partially vaporized therein, and removing resultant liquid-vapor mixture from the heat exchanger at the top end above the level of the liquid bath. This system provides pump-free circulation of the sump liquid and the use incorporates an on-line adsorber to remove deleterious impurities from the sump liquid, e.g., hydrocarbons from oxygen.

16 Claims, 3 Drawing Figures

$N_2$ 1
2
3
4
5
6
7
8
9
10
11
12
13
14
15
16
17
18
19
20
21
22
$O_2$
LI
LI
FI

CONTINUOUS SYSTEM OF RECTIFICATION

BACKGROUND OF THE INVENTION

This invention relates to an improved process and apparatus for the fractionation of a gaseous mixture by rectification wherein liquid in the sump of the rectifying column is heated and partially vaporized; and simultaneously liquid is withdrawn from the bottom zone of the sump liquid bath and recycled into the sump liquid bath at a point above the withdrawal point.

One process of this type has been described in German Pat. No. 2,238,866. The sump liquid is heated and partially vaporized by a condenser-evaporator disposed in the sump of the rectifying column, said condenser-evaporator being partially immersed in sump liquid during the operation of the column. On the condensation side of the evaporator-condenser, reflux liquid is produced for the rectification. The German patent particularly relates to the removal of sump liquid from the column in order, for example, to remove undesirable components from the sump liquid, and to the recycling of the resultant purified liquid to the pump. To avoid the use of recirculating pumps which otherwise not only result in expenditures in apparatus and energy, but also can prove hazardous, for example, in air fractionation for the recirculation of liquid oxygen, due to danger of explosion, the German patent discloses a system wherein the sump liquid is conveyed into a storage tank arranged above the sump liquid by means of the existing pressure difference between the liquid withdrawal point and the product discharge conduit. The stored liquid is eventually recycled into the column sump, utilizing the pressure gradient. More specifically, in a first switching phase, the storage tank is connected to the product conduit, and liquid is conveyed into the tank. In a second switching phase, the communication to the product conduit is disconnected, and the liquid is recycled from the storage tank into the column sump. Accordingly, with the use of the disclosed arrangement, liquid can be circulated without the utilization of a pump.

A disadvantage of this procedure is that the circulation does not take place continuously. Moreover, the storage tank and the required switching valves represent additional expenditure in apparatus and increase the space requirements for the plant.

SUMMARY OF THE INVENTION

An object of this invention is to provide a process of the above-described type improved from the standpoint of providing continuous circulation and without the necessity of significant additional costs.

Upon further study of the specification and appended claims, further objects and advantages of this invention will become apparent to those skilled in the art.

To attain these objects, there is provided, in a process for the fractionation of a gaseous mixture by rectification, wherein liquid in the sump of a rectifying column is heated and thereby partially vaporized; and simultaneously sump liquid is withdrawn from a lower zone of the sump liquid bath, and is recycled into the bath above the point of withdrawal, the improvement which comprises the steps, prior to the recycle step, of passing the withdrawn sump liquid from the lower zone into a heat exchanger, said heat exchanger having a bottom end at a level below the liquid level of the sump, and a top end at a level higher than the liquid level of the sump; said withdrawn sump liquid being passed into the bottom end of said heat exchanger and partially vaporized therein, and removing resultant liquid-vapor mixture from the heat exchanger at the top end above the level of the liquid bath.

The heat exchanger can be the condenser-evaporator already present in the sump, or it can be one or several additional evaporators. The heat exchanger, located so that it is partially immersed in the sump liquid during the operation of the rectifying column, is sealed against the sump liquid on the bottom end immersed in the liquid. The withdrawn portion of the sump liquid is fed, according to the invention, to the lower end of the heat exchanger and, theoretically, would rise therein to a level corresponding to the liquid level of the sump liquid minus an amount corresponding to the pressure drop in the withdrawal pipes. Due to the fact that a portion of the liquid is boiled in the heat exchanger, boil-over entrained liquid also escapes over the upper rim of the heat exchanger. The upper rim is open towards a vapor space in the interior of the rectifying column, permitting the vapor to rise and allowing the boil-over liquid to settle into the sump liquid surrounding the heat exchanger.

In this way, sump liquid is continuously withdrawn from the lower zone of the sump liquid bath and boil-over liquid as well as reflux liquid from the bottom plate are fed from above to the liquid bath. The resultant continuous liquid circulation can thus be conducted without any significant additional investment in apparatus.

The omission of total vaporization of the liquid in the heat exchanger helps prevent encrustation of the heat-exchange surfaces. It is preferred in this connection that about 5 to 50%, especially about 10 to 30%, of the liquid entering the exchanger be vaporized, the remainder overflowing as boil-over liquid.

The reason why total vaporization must be avoided, is that in the absorbers, hydrocarbons are not totally eliminated from the air and therefore, will enrich in the liquid in the heat exchanger. In case of total vaporization, the hydrocarbons would precipitate on the heat-exchange surfaces.

In an advantageous further development of the process of this invention, at least part of the withdrawn sump liquid is passed through an adsorber where undesirable components are removed. In conjunction therewith, it is preferred that the system have an adsorber by-pass line so that the amount of liquid conducted via the adsorber can be adjusted independently of the amount of circulated liquid.

In an advantageous embodiment of the invention, gas bubbles are separated from the liquid before the latter is fed to the heat exchanger.

If no gas bubbles are in the flow cross-section of conduits and heat exchanger, the pressure drop therein is smaller and, as resulting advantage, more boil-over liquid can be propelled from the heat exchanger.

The pump-free continuous circulation process of this invention is especially suitable for low-temperature air rectification because of the possible buildup of hydrocarbons, e.g., acetylene, in the oxygen-enriched, liquid sump fraction produced during air fractionation—which fraction should never be circulated, for safety reasons, by a pump.

For effecting the partial vaporization of the oxygen-enriched liquid in the heat exchanger, it is advantageous for gaseous air or gaseous nitrogen to be utilized as an indirect heat transfer fluid. If nitrogen is employed, it must of course, be employed under a sufficient increased pressure to maintain the temperature difference required for the partial vaporization of the oxygen.

A convenient apparatus for conducting the process of this invention comprises a rectifying column, a heat exchanger arranged in the sump of the rectifying column, as well as a withdrawal conduit, one end of which terminates in the lower zone of the rectifying column, and the other end of which is connected to the lower end of the heat exchanger.

In another embodiment of this invention, a liquid-level indicator is connected in parallel with the heat exchanger. Thereby, the liquid level in the heat exchanger can be externally controlled, by valve adjustment in the circulation line.

In another preferred embodiment of the present invention, a gas separator or trap is connected to the withdrawal conduit terminating in the heat exchanger. For this purpose the pipeline extends upwardly in the vertical direction upstream of the connection point of the liquid-level indicator and exhibits, between the connection point and the heat exchanger, at least a short, horizontal or downwardly inclined section, whereas the gas separator is arranged essentially perpendicularly above the connection point. Gas bubbles contained in the liquid can thus rise unimpeded into the gas separator.

BRIEF DESCRIPTION OF THE DRAWINGS

In the drawings which constitute preferred embodiments of the invention.

DETAILED DESCRIPTION OF THE DRAWINGS

Figure 1:
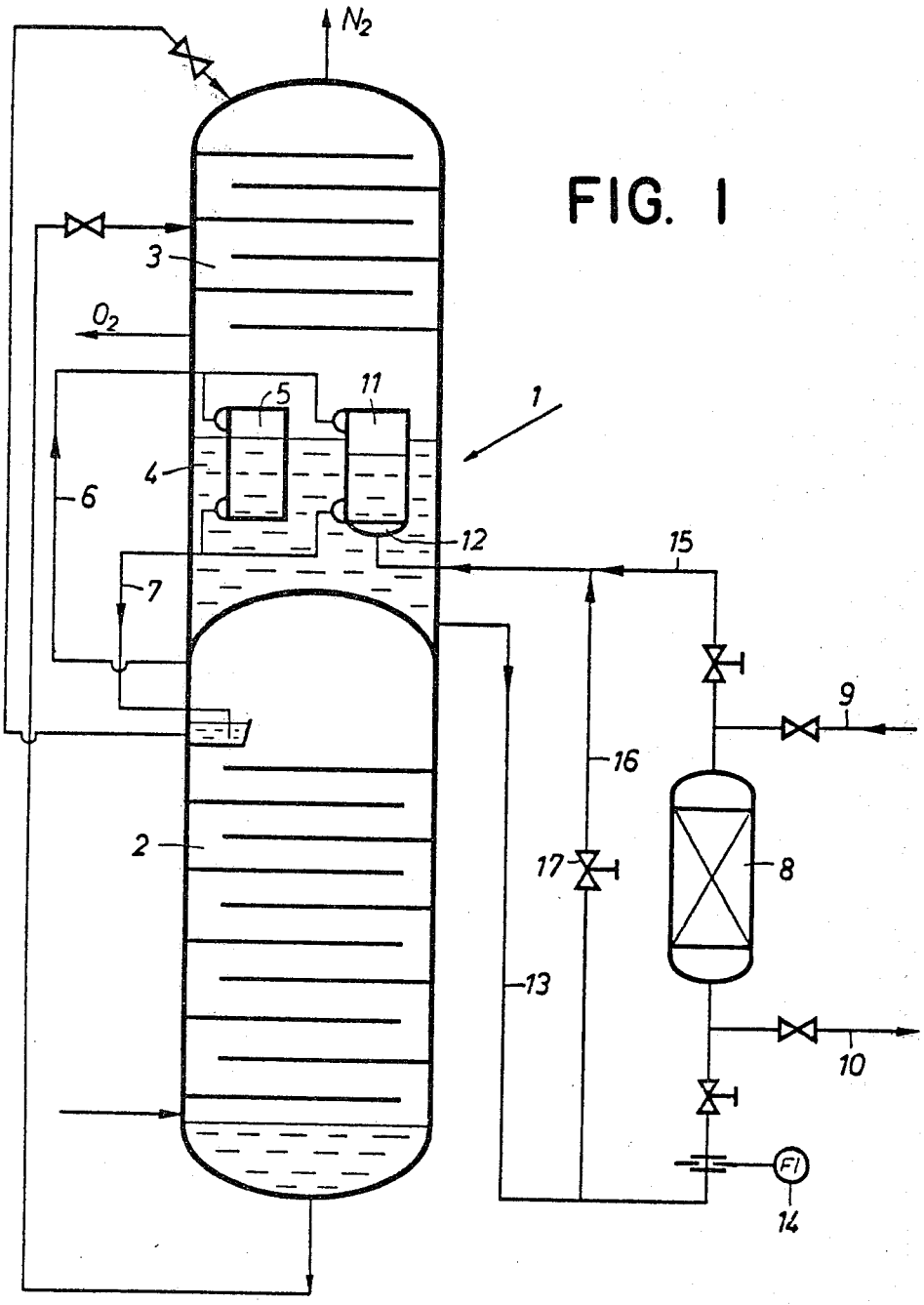
FIG. 1 is a schematic flowsheet comprising a rectifying column combined with an adsorber and incorporating the circulatory system of the invention.

Analogous components are identified by identical reference numerals in both figures. Numeral 1 denotes a two-stage rectifying column utilized for low-temperature air fractionation. It is just as easily possible however, to utilize a single-stage rectifying column, instead of the illustrated two-stage rectifying column having a high-pressure stage 2 and a low-pressure stage 3 arranged above the high-pressure stage. Moreover, the process of this invention is just as suitable for use in the rectification of other gaseous mixtures, e.g. oxygen-nitrogen, oxygen-argon, or nitrogen-argon.

During air fractionation, an oxygen-enriched liquid 4 is collected in the sump of the low-pressure column 3. A condenser-evaporator 5 arranged in the sump liquid produces reflux liquid for the high-pressure column 2. For this purpose, a nitrogen-enriched gaseous fraction is withdrawn (conduit 6) from the head of the column 2 and fed to the condenser-evaporator 5 wherein the gas is partially liquefied in heat exchange with the oxygen-enriched sump liquid 4; during this step part of the sump liquid 4 is vaporized. The condensed liquid is returned into the high-pressure stage 2 via conduit 7.

Since undesirable components, especially hydrocarbons such as acetylene, are still contained in the sump liquid 4, a portion of the liquid is circulated via an adsorber 8 wherein these components are removed. Nitrogen, for example, is utilized for regenerating the adsorbers, this nitrogen being fed via conduit 9 and removed via conduit 10. The adsorber 8 is located at a lower level than the liquid bath 4.

According to the invention, a heat exchanger 11 arranged in the sump 4 of the rectifying column serves for liquid circulation; this heat exchanger is partially immersed in the liquid bath during the operation of the column. By partially immersed it is meant that at least the upper open end extends above the liquid level.

The heat exchanger 11, for example a plate-type heat exchanger, is open at its upper end projecting beyond the liquid 4 toward the inside of the low-pressure stage 3; its lower end, immersed in the liquid, is sealed against the sump liquid, for example with a header 12. Normally, such heat exchangers are open at the upper and the lower ends of their evaporator cross-sections.

The heat exchanger is connected in parallel to the condenser-evaporator 5 to the nitrogen conduits 6 and 7. As illustrated in the figures, the heat exchanger can be an additional evaporator; however, it is also possible to construct part of the heat-exchange tubes of the condenser-evaporator 5 in such a way that direct communication between the heat-exchange tubes and the sump liquid is prevented. This means that if only one condenser-evaporator is provided, at the lower end of this heat exchanger a part of the evaporator cross-section is sealed, for example with a header.

At the lower end of the low-pressure column 3, a liquid withdrawal conduit 13 is provided which is in communication with the adsorber 8. A flowmeter 14 is arranged in conduit 13. The other end of the adsorber 8 is connected to a conduit 15 terminating in the header 12 of the heat exchanger 11.

When conducting the process of this invention, liquid is withdrawn via conduit 13 from the column sump 4, passes into the adsorber 8 where it is freed of hydrocarbons, and from there via conduit 15 into the header 12 from where it is distributed over the heat-exchange tubes of the heat exchanger 11. The liquid rises in the heat exchanger 11 to a level equal to the liquid level of the sump liquid 4 minus an amount corresponding to the flow resistance in the liquid withdrawal conduit 13 and 15 and in the adsorber 8. Due to the warm nitrogen fed via conduit 6, a portion of the liquid in heat exchanger 11 is vaporized. Liquid is entrained by the escaping vapor and this boil-over liquid is propelled over the upper rim of the heat exchanger 11 into the liquid bath. The evaporated quantity of liquid is replaced by liquid flowing off from the rectifying plates. Thus, the liquid level of the bath, which had dropped due to the removal of liquid, rises again, and the static liquid pressure in pipeline 13 is increased. The process thus operates continuously.

Figure 3:
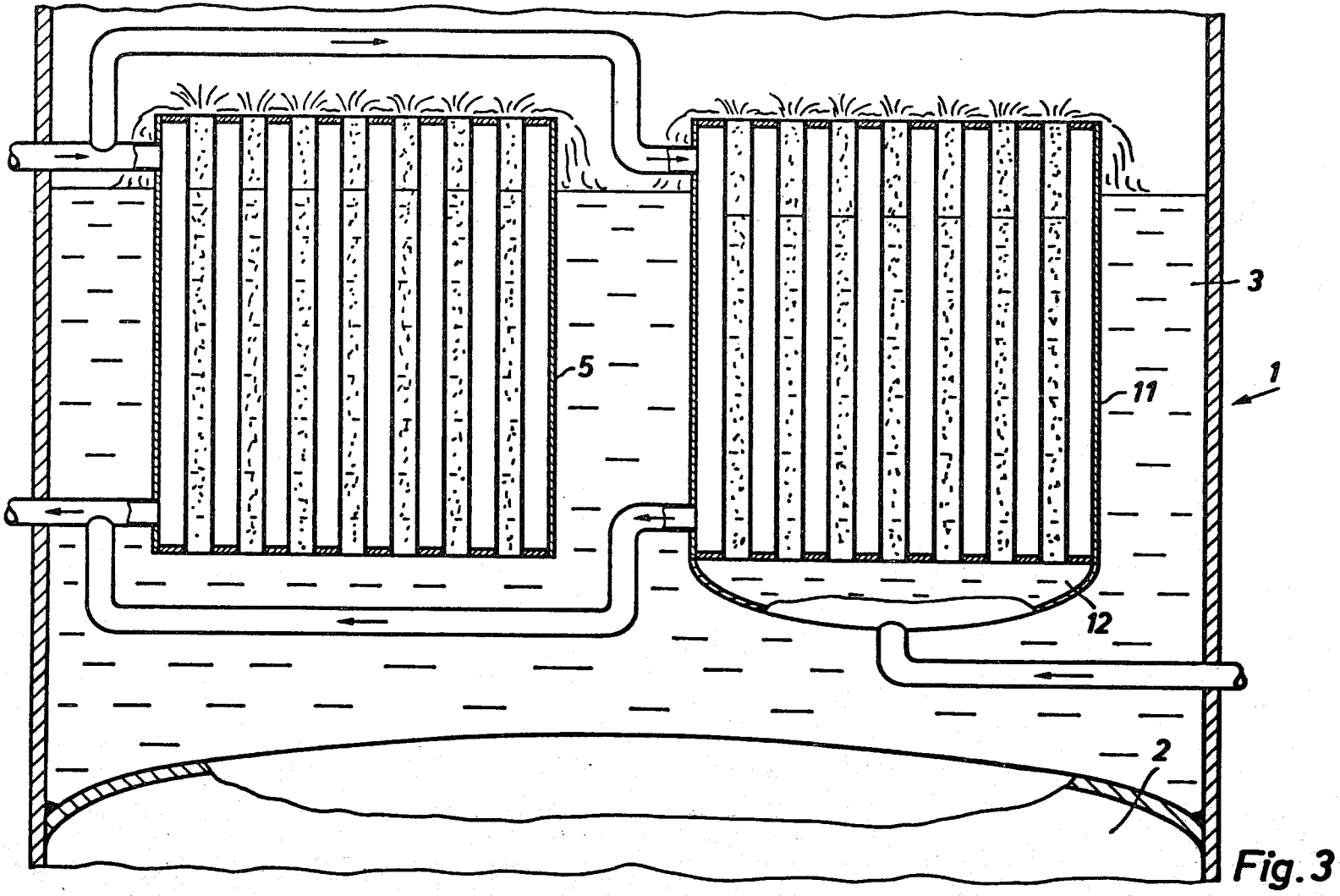
FIG. 3 is a schematic diagram showing, in greater detail, heat exchangers of the type capable of use in the rectifying column of the system of the invention.

It should furthermore be pointed out that, as also shown in FIG. 3, the overflow of boil-over liquid also takes place in the evaporator-condenser 5. The liquid therein is replenished via the connection of the bottom of the evaporator-condenser 5 with the liquid bath 4. In contrast thereto, a direct backflow of liquid through the header 12 is prevented in heat exchanger 11. Here the liquid flows via pipelines 13 and 15 back into the heat exchanger until, in accordance with the principles of hydrostatics, a liquid level is reached corresponding to the liquid level of the sump liquid 4. Since simultaneously, additional liquid is vaporized from the heat exchanger resulting in the propulsion of boil-over liquid as well, the liquid level lags behind the equilibrium condition and a continuous liquid circulation is ensured. It is possible to heat the evaporator 11 with air in place of nitrogen, and it is just as well possible to replace the single evaporator with several such evaporators.

The amount of liquid circulated via the adsorber 8 should approximately correspond to the amount of oxygen obtained during rectification. To be able to control the quantity of liquid independently of the circulated quantity, a bypass conduit 16 is arranged in parallel to the adsorber 8, this bypass conduit being equipped with a control valve 17. The level of the liquid in the heat exchanger can simultaneously be adjusted with the aid of this bypass conduit 16, because a total vaporization of the liquid in heat exchanger 11 must be avoided to prevent encrustation of the heat-exchange surfaces. This becomes more important because the danger of explosion exists when actylene is crystallized. The heat exchanger is to be maintained with liquid preferably to an extent of about 60 to 100%, and particularly of about 80% of the available space for liquid to be vaporized.

Figure 2:
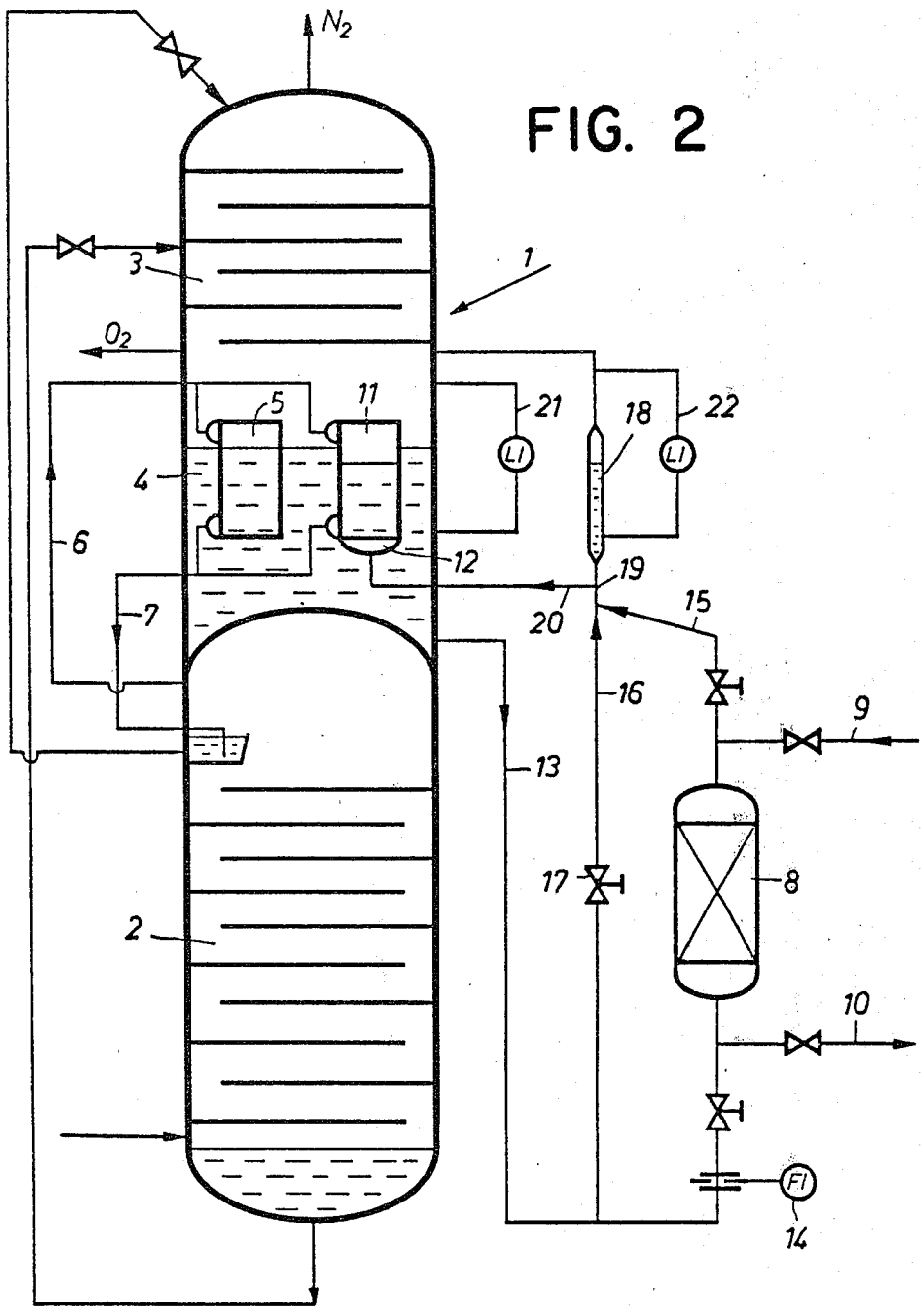
FIG. 2 shows a modified arrangement of FIG. 1, containing liquid level indicators and a gas trap for the liquid prior to entering the heat exchanger.

FIG. 2 shows essentially the same arrangement as FIG. 1. In addition, a gas separator 18 is included which is connected in parallel to the heat exchanger 11. With the aid of liquid-level indicators 21 and 22, the height of the liquid level in the column sump and in the heat exchanger 11 can be readily controlled from the outside, and thus the optimum liquid level can always be set. By optimum liquid level is meant that level within the indicated range which leads to a minimum difference between the liquid levels in heat exchangers 5 and 11.

What is claimed is:

1. In a process for conducting the fractionation of a gaseous mixture by rectification, wherein liquid in the sump of a rectifying column is heated and thereby partially vaporized, and simultaneously sump liquid is withdrawn from a lower zone of the sump liquid bath and is remixed with the bath above the point of withdrawal, the improvement comprising the steps of:

passing the withdrawn sump liquid through an adsorber for removing impurities therefrom;

separating gas bubbles from the withdrawn sump liquid, said separating of gas bubbles being performed before recycling the liquid into a heat exchanger located in the rectifying column, and in parallel flow to the heat exchanger;

subsequently passing the adsorber purified sump liquid into the lower end of the heat exchanger located in the rectifying column, said heat exchanger having the lower end thereof immersed in the sump liquid and sealed therefrom, and its upper end being in open communication with the gas containing space above the sump liquid; and partially vaporizing the adsorber purified sump liquid in the heat exchanger and thereby entraining liquid in the heat exchanger with escaping vapor to propel the entrained liquid over the open upper rim of the heat exchanger to be remixed into the sump liquid bath.

2. In a process for the fractionation of a gaseous mixture by rectification, wherein liquid in the sump of a rectifying column is heated and thereby partially vaporized, and simultaneously sump liquid is withdrawn from a lower zone of the sump liquid bath and is remixed with the bath above the point of withdrawal, the improvement comprising the steps of:

passing the withdrawn sump liquid through an adsorber for removing impurities therefrom;

subsequently passing the adsorber purified sump liquid into the lower end of a heat exchanger located in the rectifying column having its lower end immersed in the sump liquid and sealed therefrom, and its upper end in open communication with the gas containing space above the sump liquid; and partially vaporizing the adsorber purified sump liquid in the heat exchanger thereby entraining liquid in the exchanger with escaping vapor to propel the entrained liquid over the open upper rim of the heat exchanger to be remixed into the sump liquid bath.

3. A process as in claim 2 further comprising selectively bypassing the flow through the adsorber to cause the withdrawn sump liquid to flow directly into the lower end of the heat exchanger.

4. A process as in claim 2 wherein said partially vaporizing step comprises vaporizing 5 to 50% of the liquid entering the heat exchanger.

5. A process as in claim 2 wherein said partially vaporizing step comprises vaporizing 10 to 30% of the liquid entering the heat exchanger.

6. A process as in claim 2 or 3 further comprising the step of maintaining the heat exchanger filled with liquid to at least 60% of its volume capacity.

7. A process as in claim 2 or 3 further comprising the step of maintaining the heat exchanger filled with liquid to about 80% of its volume capacity.

8. In an apparatus for conducting the fractionation of a gaseous mixture by rectification in a rectifying column, the column having a liquid drain line connected to the sump thereof and to an adsorber for passing sump liquid through the adsorber, the improvement comprising:

heat exchanger means mounted within the rectifying column partly for being immersed in the liquid in the sump, and the upper end thereof for being in open communication with the gas containing space above the sump liquid; a header located at the lower end of the heat exchanger means for sealing the heat exchanger means from the liquid in the sump; and a connecting line connecting the lower end of the heat exchanger means with the adsorber for receiving sump liquid after the sump liquid passes through the adsorber, whereby the sump liquid passing into the heat exchanger means is partially vaporized thereby entraining liquid in the heat exchanger means with the escaping vapor to propel the entrained liquid over the open upper rim of the heat exchanger means to be remixed into the sump liquid bath.

9. An apparatus for fractionation as in claim 8 further comprising liquid level indicating means mounted in parallel with the heat exchanger means and operatively associated therewith for monitoring the liquid level in the heat exchanger means.

10. An apparatus for fractionation as in claim 8 or 9 further comprising bypass means parallel to the adsorber and connecting the liquid drain line with the connecting line for selectively bypassing flow through the adsorber and for adjusting the liquid level in the heat exchanger means.

11. An apparatus for fractionation as in claim 10 further comprising gas separating means connected to the connecting line and to the rectifying column, in parallel to the heat exchanger.

12. An apparatus for fractionation as in claim 9 further comprising gas separating means connected to the connecting line and to the rectifying column, in parallel to the heat exchanger means.

13. An apparatus for fractionation as in claim 8 wherein said heat exchanger means is adapted for vaporizing 5 to 50% of the liquid entering said heat exchanger means through said connecting line.

14. An apparatus for fractionation as in claim 8 wherein said heat exchanger means is adapted for vaporizing 10 to 30% of the liquid entering said heat exchanger means through said connecting line.

15. In an apparatus for conducting the fractionation of a gaseous mixture by rectification in a rectifying column, the column having a liquid drain line connected to the sump thereof and to an adsorber for passing sump liquid through the adsorber, the improvement comprising:

heat exchanger means mounted within the rectifying column partly for being immersed in the liquid in the sump, and the upper end thereof for being in open communication with the gas containing space above the sump liquid; a header located at the lower end of the heat exchanger means for sealing the heat exchanger means from the liquid in the sump; and a connecting line connecting the lower end of the heat exchanger means with the adsorber for receiving sump liquid after the sump liquid passes through the adsorber, and said connecting line having gas separating means connected thereto and to the rectifying column in parallel to the heat exchanger means, whereby the sump liquid passing into the heat exchanger means is partially vaporized thereby entraining liquid in the heat exchanger means with the escaping vapor to propel the entrained liquid over the open upper rim of the heat exchanger means to be remixed into the sump liquid bath.

16. An apparatus for fractionation as in claim 15 further comprising bypass means parallel to the adsorber, and connecting the liquid drain line with the connecting line for selectively bypassing flow through the adsorber and for adjusting the liquid level in the heat exchanger means.

* * * * *